US007559296B2

(12) United States Patent
Perotto

(10) Patent No.: US 7,559,296 B2
(45) Date of Patent: Jul. 14, 2009

(54) COOLING SPRAYER WITH VALVE

(75) Inventor: Stéphane Perotto, Ayze (FR)

(73) Assignee: Bontaz Centre, Marnaz (FR)

( * ) Notice: Subject to any disclaimer, the term of this patent is extended or adjusted under 35 U.S.C. 154(b) by 0 days.

(21) Appl. No.: 12/047,854

(22) Filed: Mar. 13, 2008

(65) Prior Publication Data

US 2008/0223318 A1 Sep. 18, 2008

(30) Foreign Application Priority Data

Mar. 16, 2007 (FR) ..... 07 53892

(51) Int. Cl.
*F01P 1/04* (2006.01)
*F16K 15/00* (2006.01)
*B05B 1/30* (2006.01)

(52) U.S. Cl. ..... 123/41.35; 137/540; 239/570

(58) Field of Classification Search ..... 123/41.35; 137/536, 538, 539, 540, 543.19; 239/570, 239/571

See application file for complete search history.

(56) References Cited

U.S. PATENT DOCUMENTS 3,729,018 A * 4/1973 Butterfield ..... 137/501
6,672,262 B2 1/2004 Bontaz
2005/0072476 A1 4/2005 Neto
2005/0252997 A1 11/2005 Gluck et al.
2006/0243226 A1 11/2006 Bontaz et al.

FOREIGN PATENT DOCUMENTS

| | | |
|---|---|---|
| DE | 102 61 180 | 7/2004 |
| EP | 1 273 774 | 1/2003 |
| EP | 1 728 981 | 12/2006 |
| JP | 07 317519 | 12/1995 |
| WO | WO 2005/026591 | 3/2005 |

OTHER PUBLICATIONS

FR Search Report for FR 0753892; Completed Sep. 27, 2007; (an English language search report attached).

* cited by examiner

*Primary Examiner*—Noah Kamen
(74) *Attorney, Agent, or Firm*—RatnerPrestia

(57) ABSTRACT

The internal combustion engine piston cooling sprayer comprises a sprayer body (1) with an axial through-passage (12) in which is fixed a tubular guide liner (4). The tubular guide liner (4) is fixed in the sprayer body (1) by its downstream section (4*c*), while its upstream section (4*b*) remains away from the wall of the axial through-passage (12), to allow the cooling fluid to flow. A valve (2) slides in an axial through-passage of the tubular guide liner (4), and is urged by a return spring (3) toward a main seat formed in the mass of the sprayer body (1). This produces a compact and reliable sprayer of relatively low cost.

10 Claims, 6 Drawing Sheets

COOLING SPRAYER WITH VALVE

TECHNICAL FIELD OF THE INVENTION

The present invention concerns sprayers for cooling the pistons of an internal combustion engine, used to spray a cooling fluid such as oil against the piston bottom, i.e. against the piston face external to the combustion chamber, or into a piston gallery.

The piston cooling sprayers usually employed are separate components fixed to the engine block and communicating with a cooling fluid feed orifice. The position of the sprayer is determined precisely to produce a jet of cooling fluid directed toward a precise area of the piston bottom or the piston gallery.

Cooling sprayers usually include a valve for inhibiting the flow of cooling fluid unless the pressure of the cooling circuit exceeds a particular threshold value.

Sprayer structures are generally used in which the valve is urged by a compression spring toward a seat to block a cooling fluid passage.

It has been found that certain cooling sprayers with a valve are satisfactory for a limited period, after which wear phenomena occur that interfere with the seal of the valve and its correct operation. The period of correct operation is inversely proportional to the nominal pressure of the cooling fluid in the cooling pipes. Wear modifies mainly the opening characteristics of the valve, i.e. the fluid pressure necessary to open it: when new, the valve opens at a correct nominal pressure; when worn, the valve opens at a lower pressure, which can be as low as half the correct nominal pressure, and thus below the idling regime of the engine. This results in interference with the general pressure of the fluid in the engine.

It has been observed that wear is inevitable if phenomena of oscillation and vibration of the valve occur.

There is known from the document JP 07 317519 A an engine cooling sprayer the valve whereof is a piston urged against a seat by a spring and sliding in an axial bore communicating with a radial fluid passage. The phenomena of vibration and wear are reduced. However, the piston-type sprayers of the document JP 07 317519 A have a relatively large overall size, and in particular a relatively long length downstream of the outlet orifices of the sprayer for guiding the piston. The sprayer body therefore constitutes a protuberance into the interior of the engine cylinder. Too great a length downstream of the outlet orifices of the sprayer leads to a risk of collision with the rotary elements of the motor such as the crankshaft or the crankshaft counterweight, and therefore rules out the use of such sprayers in certain engines.

There is proposed in the document EP 1 273 774 A1 a cooling sprayer structure that prevents vibration of the valve and at the same time reduces the overall size of the sprayer body inside the engine cylinder. In the first embodiment described in this document, the sprayer body comprises an axial passage through it in which are accommodated a tubular guide liner with an axial passage through it and a valve in the form of a piston cooperating with a main seat and a return spring. The sprayer body comprises an upstream section shaped to be connected to an engine cooling fluid feed passage. The sprayer body comprises an intermediate section having at least one radial outlet passage and one fluid outlet tube. The sprayer body finally comprises a downstream retaining section. The valve is mounted to slide axially in an upstream liner section toward and away from the main seat and is urged axially toward the main seat by the return spring itself accommodated in the axial passage through the tubular guide liner. The tubular guide liner comprises an intermediate section that leaves a peripheral space for axial passage of fluid between its external surface and the internal surface of the axial passage through the sprayer body, for the fluid to pass between the main seat and the radial outlet passage.

In this document, the guide liner is engaged without clearance and retained in position in an upstream bore of the axial passage through the sprayer body, and is held axially between an upstream ring mounted in the sprayer body and a downstream plug also mounted in the sprayer body. A vent is provided in the downstream plug. The main seat is formed in the guide liner.

It is found that this kind of sprayer structure is relatively costly, because it necessitates the fabrication of several components the dimensions whereof must be accurate for a satisfactory fit, and necessitates assembly of a relatively large number of components. In particular, several components such as the upstream ring, the downstream plug and the upstream guide liner section must be precision ground, as must the bores in which these components engage without clearance. The result of this is a high production cost.

SUMMARY OF THE INVENTION

The problem addressed by the present invention is that of designing a new cooling sprayer structure with a valve which avoids the phenomena of vibration and wear in operation, has a small overall size inside the engine cylinder, and comprises a smaller number of components that are themselves easier to produce, avoiding precise machining operations such as precision grinding.

To achieve the above and other objects, the invention proposes a piston cooling sprayer for internal combustion engines, including a sprayer body with an axial passage through it in which are accommodated a tubular guide liner with an axial passage through it and a valve that cooperates with a main seat and a return spring, the sprayer body having an upstream section conformed to be connected to an engine cooling fluid feed passage, an intermediate section with at least one radial outlet passage and one fluid outlet tube, and a downstream retaining section, the tubular guide liner being fixed coaxially in the axial through-passage and having an upstream section leaving a peripheral space for the axial passage of fluid between its external surface and the internal surface of the axial through-passage and between the main seat and the radial outlet passage, the valve sliding axially in the axial passage through the tubular guide liner toward and away from the main seat and being urged axially toward the main seat by the return spring accommodated in the axial passage through the tubular guide liner; according to the invention:

- the main seat is formed in the mass of the sprayer body by a shoulder in the axial through-passage,
- the tubular guide liner comprises a downstream liner section fixed in the downstream retaining section of the sprayer body beyond the radial outlet passage,
- the upstream section of the tubular guide liner terminates in an upstream end that is axially set back from the main seat, in the downstream direction, to define an annular fluid passage between the main seat and the peripheral space.

Because the tubular guide liner is held in the downstream retaining section of the sprayer body, it is no longer necessary to provide an upstream ring and a downstream plug to retain the guide liner axially. At the same time, there is no need for precision grinding of the upstream bore section receiving the upstream ring or for precision grinding of the external face of the upstream section of the tubular guide liner.

The downstream section of the tubular guide liner preferably comprises an annular end flange crimped in a downstream section with a shoulder of the axial through-passage, in the downstream retaining section of the sprayer body.

With this arrangement, the tubular guide liner is fixed efficiently in the downstream section of the sprayer body, simply and quickly, by crimping, and it can be centred sufficiently accurately to guide the valve perfectly relative to the main seat and provide a good seal upon closure of the valve.

In practice, the annular end flange can be retained in the downstream section with a shoulder of the axial through-passage by bending an end skirt of the sprayer body over the downstream end face of the annular end flange. As a result, the sprayer body can simply be fabricated by turning operations, producing in particular the end skirt.

To improve the centring and retention of the upstream liner section facing the main seat, for efficient and accurate guiding of the valve, radial excrescences can be provided on the upstream liner section that centre the upstream liner section coaxially in the axial passage through the sprayer body by bearing on the wall of the axial through-passage. In this case, the downstream liner section is retained only by the annular end flange crimped in the sprayer body retaining section. It is then possible to reduce the overall size of the sprayer body inside the engine cylinder by providing for the downstream section retaining the sprayer body to have a length just sufficient for accommodating and crimping the annular end flange of the tubular guide liner, beyond the radial outlet passage.

Nevertheless, the presence of the radial excrescences between the upstream liner section and the wall of the axial through-passage can prove a problem if those radial excrescences are situated in the upstream section of the sprayer body, which section is intended to be forcibly introduced into the bore at the end of a cooling fluid feed passage of the engine block. In fact, during this forcible engagement, the radial stresses exerted on the downstream sprayer body section are transmitted to the tubular guide liner by the radial excrescences, and can slightly deform the tubular guide liner in the radial direction and interfere with free axial sliding of the valve in the tubular guide liner. To prevent this risk, it may be preferable to place the radial excrescences downstream of the downstream sprayer body section, or to choose another way of retaining and centring the tubular guide liner: the downstream section of the tubular guide liner can then further comprise a centring section engaged in a corresponding bore of the axial through-passage, in the downstream retaining section of the sprayer body.

In all cases, the tubular guide liner can comprise, in its axial through-passage, a downstream constricting shoulder against which is engaged a return coil spring urging the valve toward the main seat and continued by a vent. The liner therefore in itself constitutes the means for retaining the return spring, and the vent enables opening of the valve as soon as a low fluid pressure is present.

In one advantageous embodiment, the tubular guide liner comprises, from its upstream end, a guiding bore in which the valve slides with a small functional clearance and that is limited by a shoulder forming a rear seat against which the valve bears in sealed fashion when it is pushed back by the fluid under pressure. The presence of the rear seat prevents the passage of fluid toward the vent when the valve is pushed to the end of its stroke by the fluid under pressure.

The rear seat is preferably disposed so that, when the valve is bearing on the rear seat, it frees a just sufficient section of the annular fluid passage for the required flow of the cooling fluid. As a result, the pressure from which the fluid urges the valve against the rear seat at the end of its stroke is significantly reduced, thereby again preventing the flow of fluid toward the vent.

BRIEF DESCRIPTION OF THE DRAWINGS

Other objects, features and advantages of the present invention will emerge from the following description of particular embodiments, given with reference to the appended drawings, in which.

DESCRIPTION OF THE PREFERRED EMBODIMENTS

Figure 1:
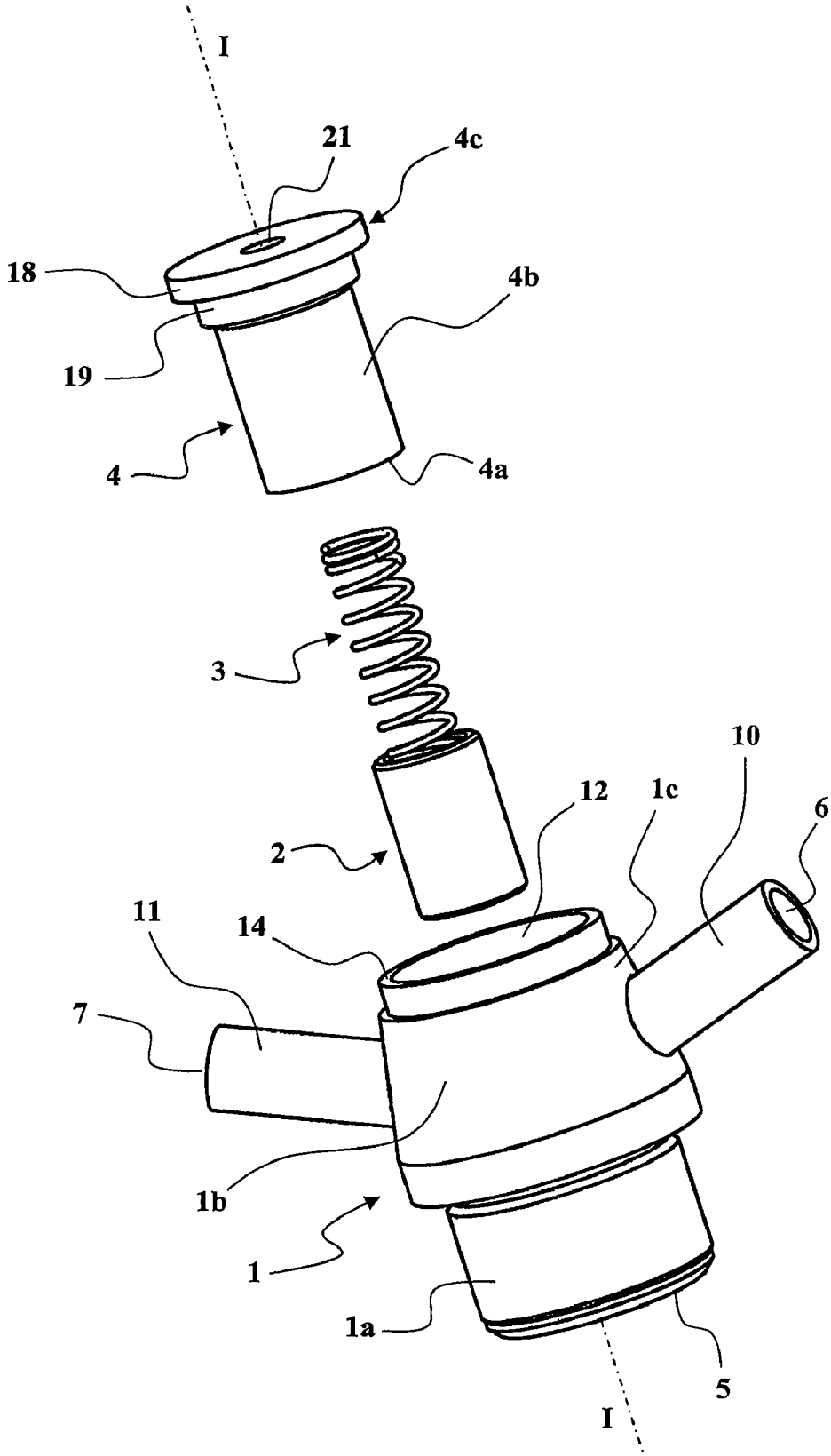
FIG. 1 is an exploded view of a cooling sprayer according to a first embodiment of the present invention.

In all the embodiments shown in the figures, the internal combustion engine piston cooling sprayer includes a sprayer body 1, a valve 2 or 2*a*, a return spring 3 and a tubular guide liner 4.

This kind of cooling sprayer is intended to receive a cooling fluid via an upstream inlet 5 and to distribute that cooling fluid via downstream radial outlets such as the outlets 6 and 7. Thus there are defined an axial direction I-I and a direction of flow of the fluid from the upstream inlet 5 in the downstream direction.

The sprayer body 1 as represented comprises an upstream section 1*a*, with a circular section cylindrical exterior surface, precision ground to be force-fitted in a sealed manner into a bore at the end of a cooling fluid feed passage of the engine (not shown). Alternatively, instead of a precision ground external surface section, other known fixing means may be provided, for example an attached fixing plate and a seal provided by an O-ring.

The sprayer body 1 comprises an intermediate section 1*b* in which are provided a first radial outlet passage 8 and a second radial outlet passage 9.

The sprayer body 1 further comprises a downstream retaining section 1*c* the function of which is essentially to retain the tubular guide liner 4 as explained hereinafter.

A first outlet tube 10 is force-fitted into the first radial outlet passage 8 and forms the first outlet 6 of the sprayer. Similarly, a second outlet tube 11 is force-fitted into the second radial outlet passage 9, and forms the second outlet 7 of the sprayer.

In the figures, the outlet tubes 10 and 11 are shown as rectilinear. In reality, they could be curved and shaped appropriately to direct the jets of the cooling fluid toward the appropriate areas of the piston or the cylinder of the engine to be cooled.

The sprayer body 1 has an axial passage 12 through it in which are accommodated the tubular guide liner 4, the valve 2 and the return spring 3. The axial through-passage 12 communicates with the outlets 6 and 7 via the radial outlet passages 8 and 9 and the outlet tubes 10 and 11.

Starting from the upstream inlet 5, the axial through-passage 12 comprises a cylindrical upstream section 12*a* of appropriate cross section for the required flow of cooling fluid and connected to an intermediate section 12*b* by a shoulder 12*c* a bevelled portion of which forms the main seat 13 of the sprayer.

The intermediate section 12*b* continues in the downstream direction beyond the radial outlet passages 8 and 9, and its downstream end is connected by a shoulder 12*d* to a cylindrical downstream section 12*e* of greater diameter in the downstream retaining section 1*c* of the sprayer body 1.

At its end opposite the upstream inlet 5, the sprayer body 1 terminates in an end skirt 14 the function of which is to retain the tubular guide liner 4, as described hereinafter.

The tubular guide liner 4 has an axial passage 15 through it, open at both ends. From the upstream end 4*a* of the tubular guide liner 4, the axial through-passage 15 includes a guide bore 15*a* in which the valve 2 or 2*a* slides with a small functional clearance and that is limited by a shoulder forming a rear seat 15*b*. Further on in the downstream direction, the axial through-passage 15 is continued in the axial direction and comprises a downstream constricting shoulder 15*c* against which the return coil spring 3 is engaged, and which is continued by a vent 21.

Considering now the exterior surface of the tubular guide liner 4, there can be seen a generally cylindrical upstream section 4*b* and a downstream section 4*c*.

The upstream section 4*b* has an outside diameter which is less than the inside diameter of the intermediate section 12*b* of the axial through-passage 12, therefore leaving a peripheral space 16 that enables axial passage of fluid from the main seat 13 as far as the radial outlet passages 8 and 9. Note that the upstream end 4*a* of the tubular guide liner 4 is axially set back from the main seat 13 in the downstream direction, to define an annular fluid passage 17 between the main seat 13 and the peripheral space 16.

In all embodiments, the valve 2 or 2*a* is mounted to slide axially in the upstream section 4*b* of the tubular guide liner 4, i.e. in the guiding bore 15*a* of the axial through-passage 15. Thus the valve 2 or 2*a* slides toward and away from the main seat 13 and is urged axially toward the main seat 13 by the return spring 3 itself accommodated in the axial through-passage 15 of the tubular guide liner 4.

The downstream section 4*c* of the tubular guide liner 4 is fixed in the downstream retaining section 1*c* of the sprayer body 1, beyond the radial outlet passages 8 and 9.

Several embodiments are described for the fixing and the centred retention of the tubular guide liner 4 in the sprayer body 1. In all cases, the downstream section 4*c* of the tubular guide liner 4 comprises an annular end flange 18 that is crimped into the downstream section 12*e* with the shoulder 12*d* of the axial through-passage 12, in the downstream retaining section 1*c* of the sprayer body 1.

In practice, the annular end flange 18 bears axially on the shoulder 12*d*, is guided laterally in the downstream section 12*e*, and is retained in the downstream section 12*e* with the shoulder 12*d* by bending the end skirt 14 of the sprayer body 1 over the downstream end face of the annular end flange 18. The tubular guide liner 4 can therefore be assembled into the sprayer body 1 simply and quickly, without necessitating particularly precise machining. An end flange 18 can nevertheless be crimped by any other appropriate crimping means.

Figure 2:
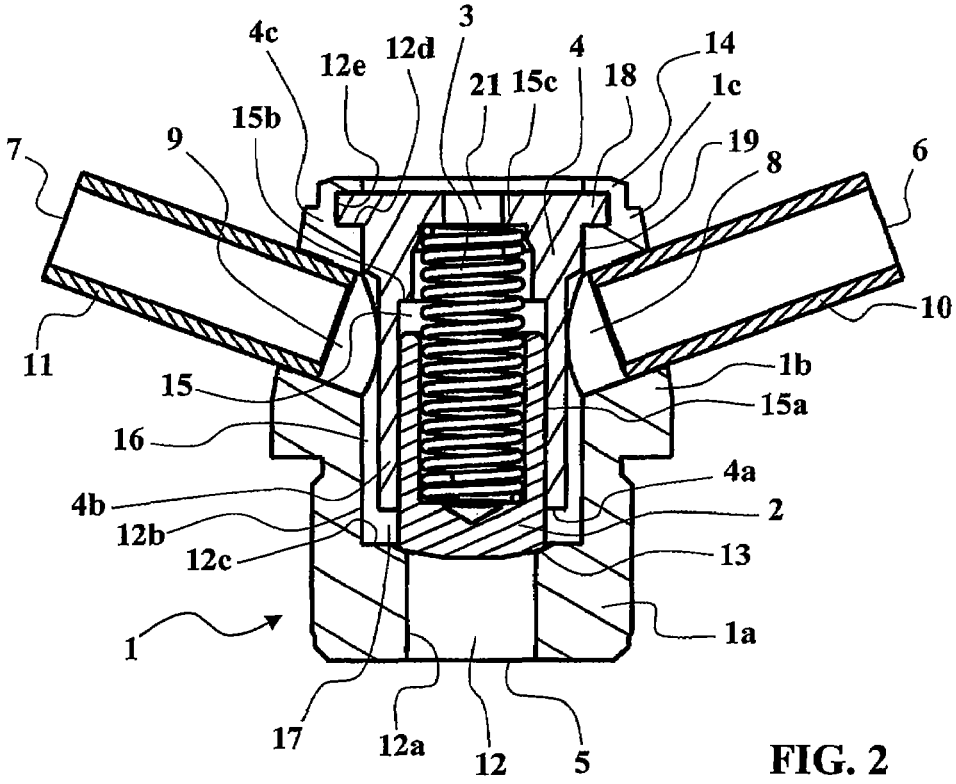
FIG. 2 is a view in longitudinal section of the sprayer from FIG. 1, in a closed configuration.
Figure 3:
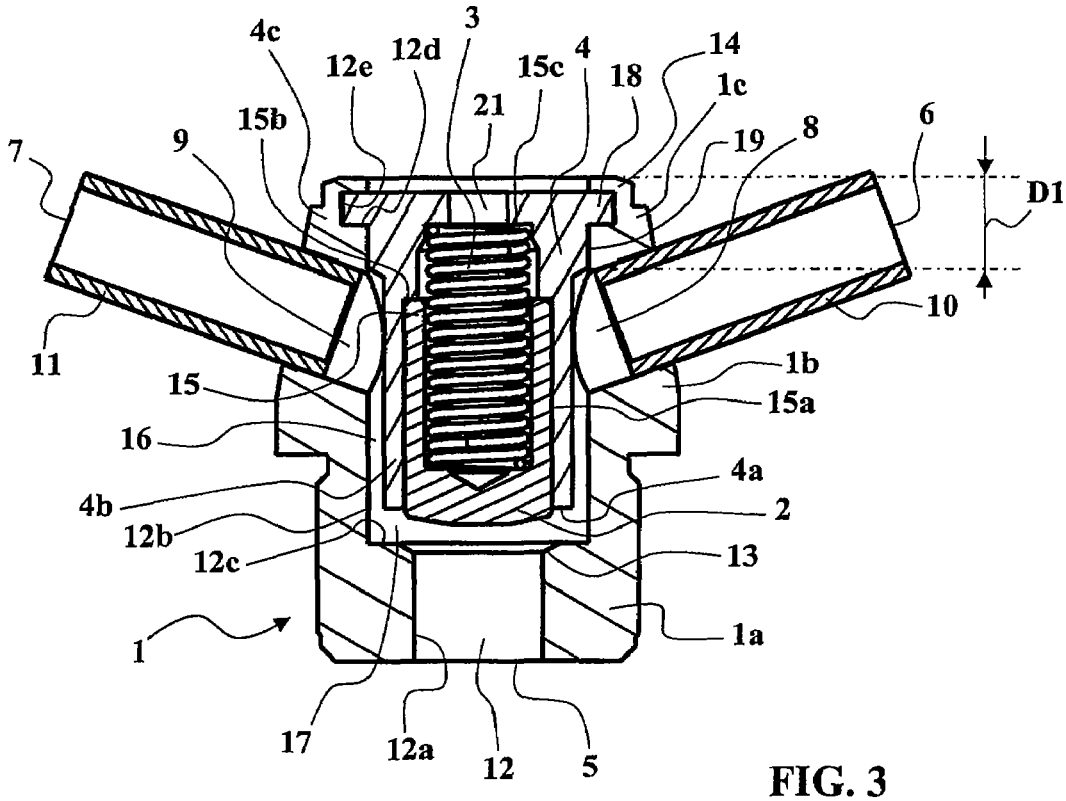
FIG. 3 is a view in longitudinal section of the sprayer from FIG. 1, in an open configuration.
Figure 7:
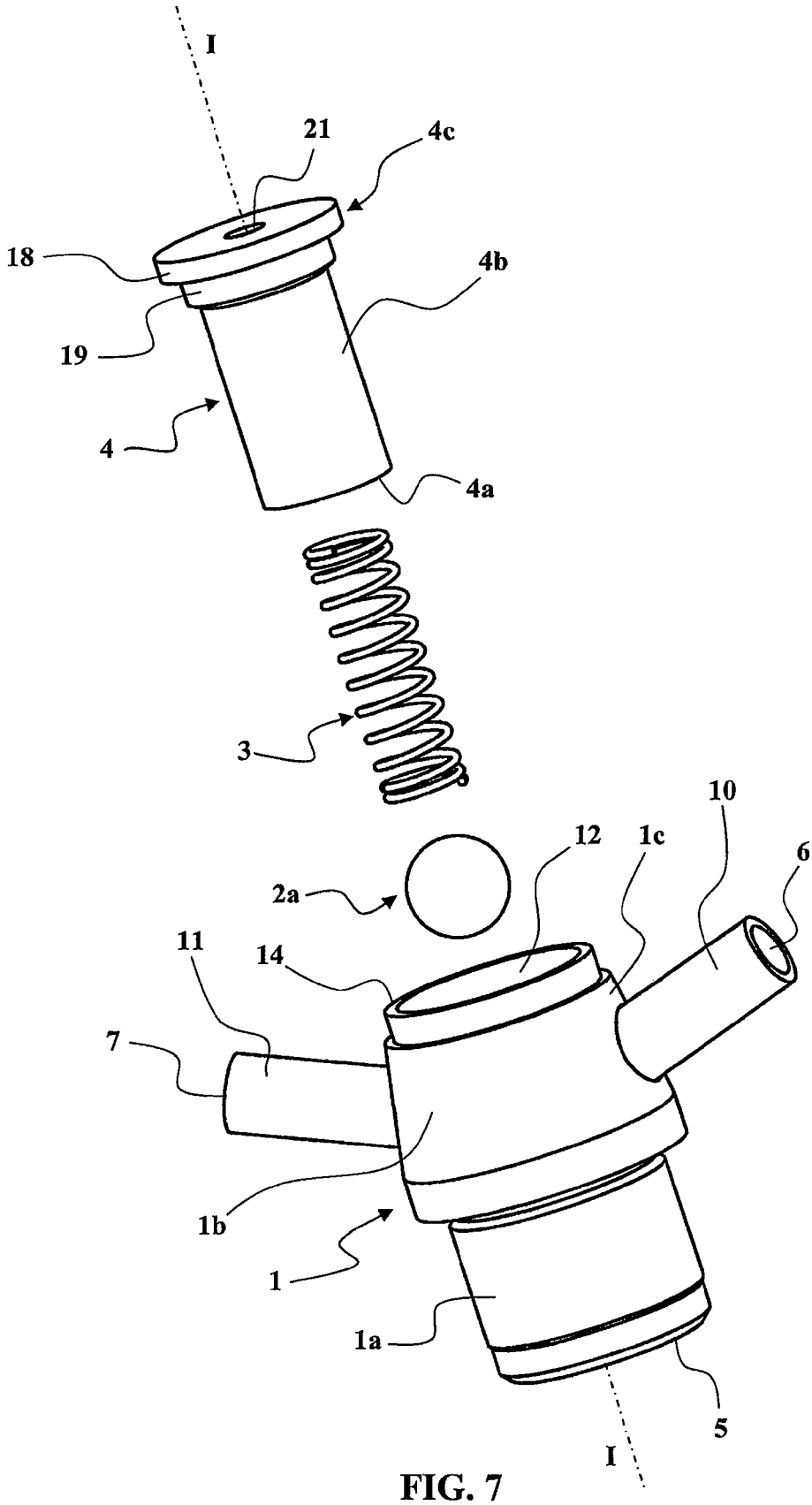
FIG. 7 is an exploded view of a cooling sprayer according to a second embodiment of the present invention.
Figure 8:
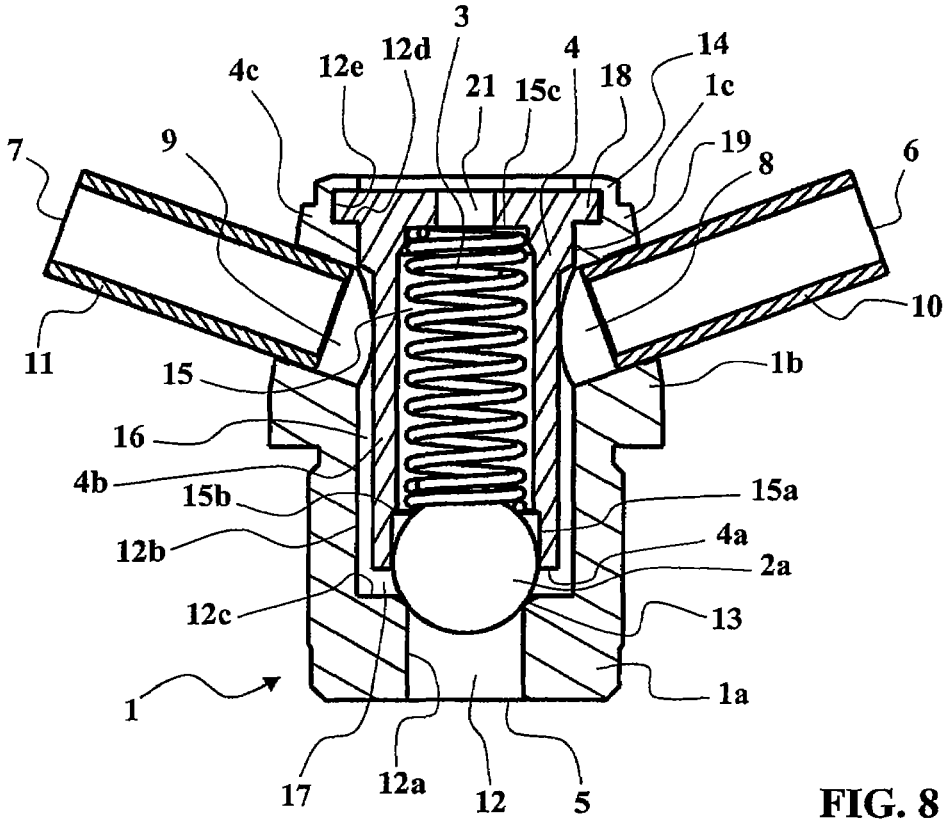
FIGS. 8 and 9 show the sprayer from FIG. 7 in longitudinal section, respectively in a closed configuration and in an open configuration.
Figure 9:
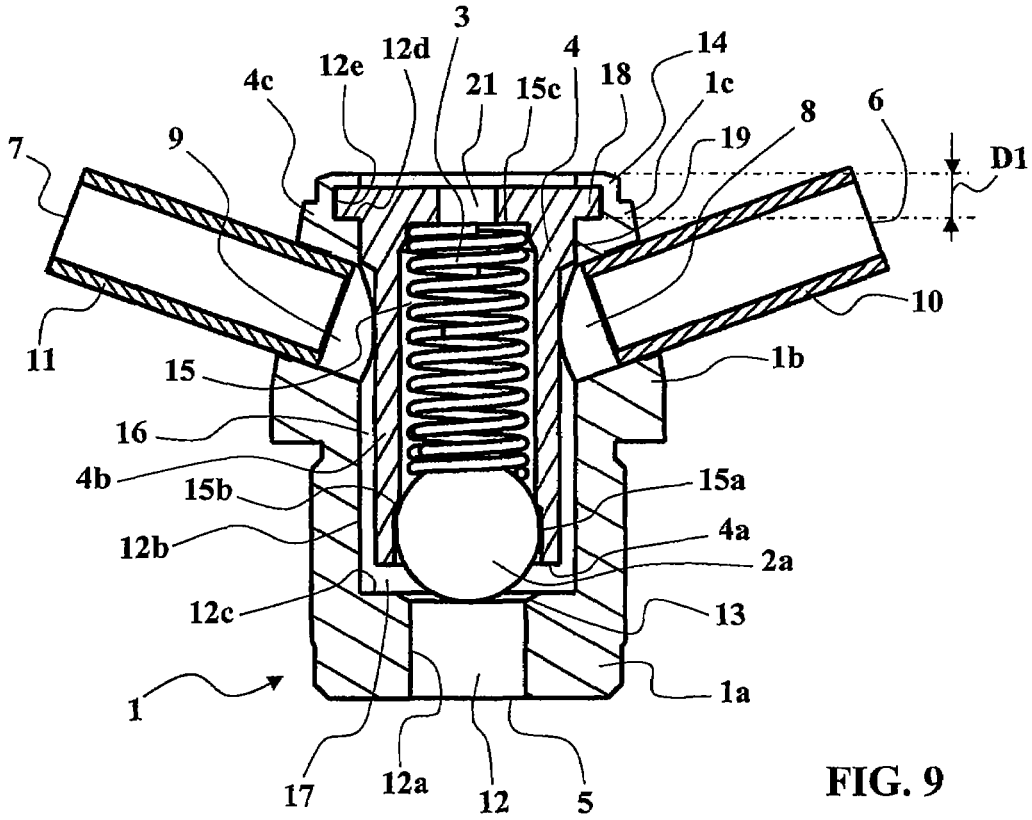

In the embodiment shown in FIGS. 1 to 3, and in the embodiment of FIGS. 7 to 9, the downstream section 4*c* of the tubular guide liner 4 further comprises a centring section 19 engaged in a corresponding bore of the axial through-passage 12. In practice, the corresponding bore is provided in the intermediate section 12*b* of the axial through-passage 12, in the downstream retaining section 1*c* of the sprayer body 1.

In those same embodiments of FIGS. 1 to 3 and 7 to 9, the tubular guide liner 4 is therefore retained only in the downstream retaining section 1*c* of the sprayer body 1. Its upstream section 4*b* is left free, without contact with the sprayer body 1, because of the existence of the peripheral space 16 and the annular fluid passage 17. The means for retaining the tubular guide liner 4 nevertheless prove sufficient to achieve good centring of the valve 2 or 2*a* relative to the main seat 13 in order to guarantee a satisfactory seal in the closed configuration.

The presence of the peripheral space 16 and the annular fluid passage 17 guarantees that the upstream section 4*b* and the tubular guide liner 4 will not be subjected to any radial stress liable to deform it and to interfere with the free axial sliding of the valve 2 or 2*a* in the tubular guide liner 4.

In the variants shown in FIGS. 4 to 6 and 10, the essential means of the previous embodiments as described with reference to FIGS. 1 to 3 and 7 to 9 are found again, and those same means are identified by the same reference numbers.

In these variants of FIGS. 4 to 6 and 10, the difference lies in the means for retaining the tubular guide liner 4: in the downstream section 4*c*, the centring section 19 is dispensed with and replaced, in the upstream section 4*b*, with radial excrescences 20, distributed at the periphery of the external surface of the upstream section 4*b*, and bearing on the wall of the axial through-passage 12 in the sprayer body 1. In this case, the tubular guide liner 4 is retained on the one hand by crimping the annular end flange 18 and on the other hand by the bearing engagement of the radial excrescences 20 in the axial through-passage 12. Clearly the transverse excrescences 20 are favourable for achieving accurate centring of the valve 2 or 2*a* relative to the main seat 13.

Figure 4:
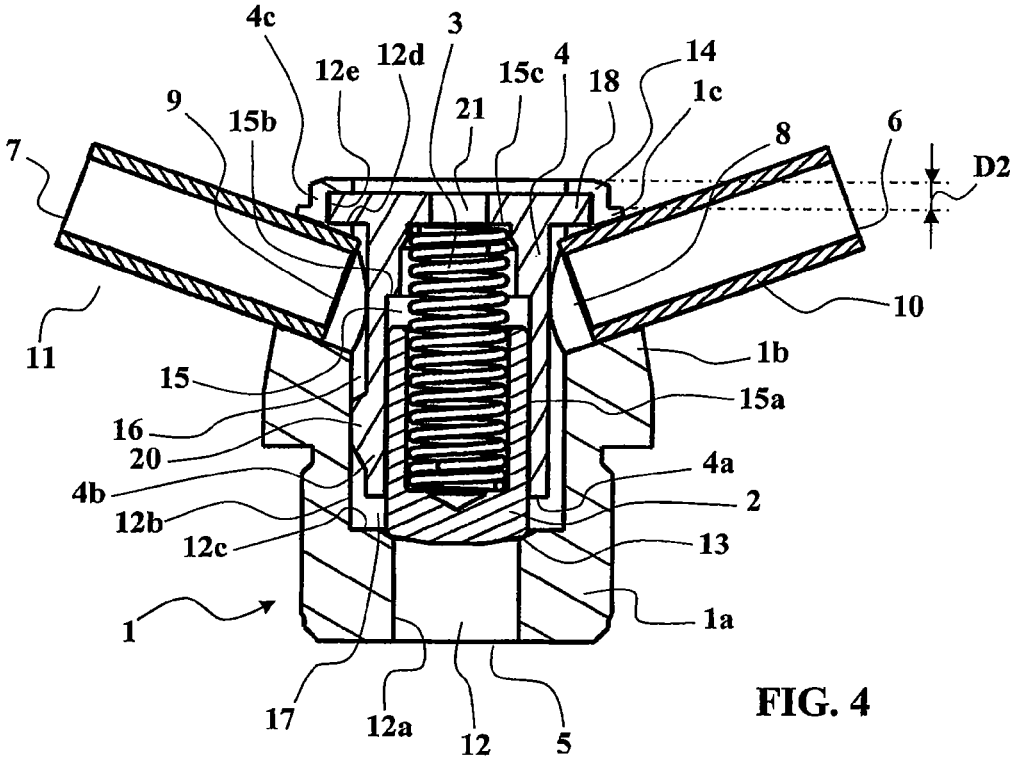
FIG. 4 is a view in longitudinal section of the sprayer from FIG. 1, in another embodiment with downstream centring of the tubular guide liner.
Figure 5:
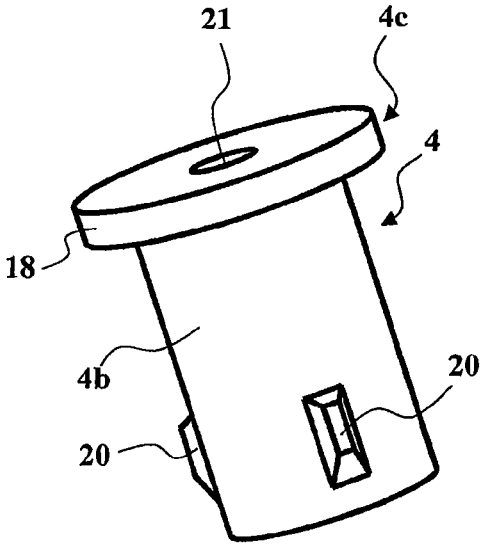
FIGS. 5 and 6 show, in perspective, two embodiments of the tubular guide liner of the FIG. 4 embodiment.
Figure 6:
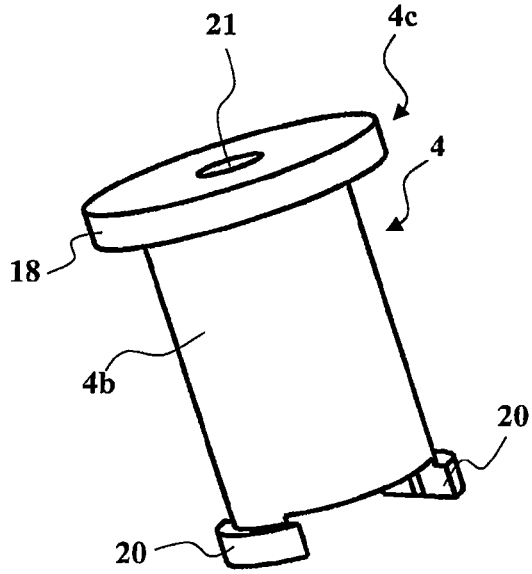
Figure 10:
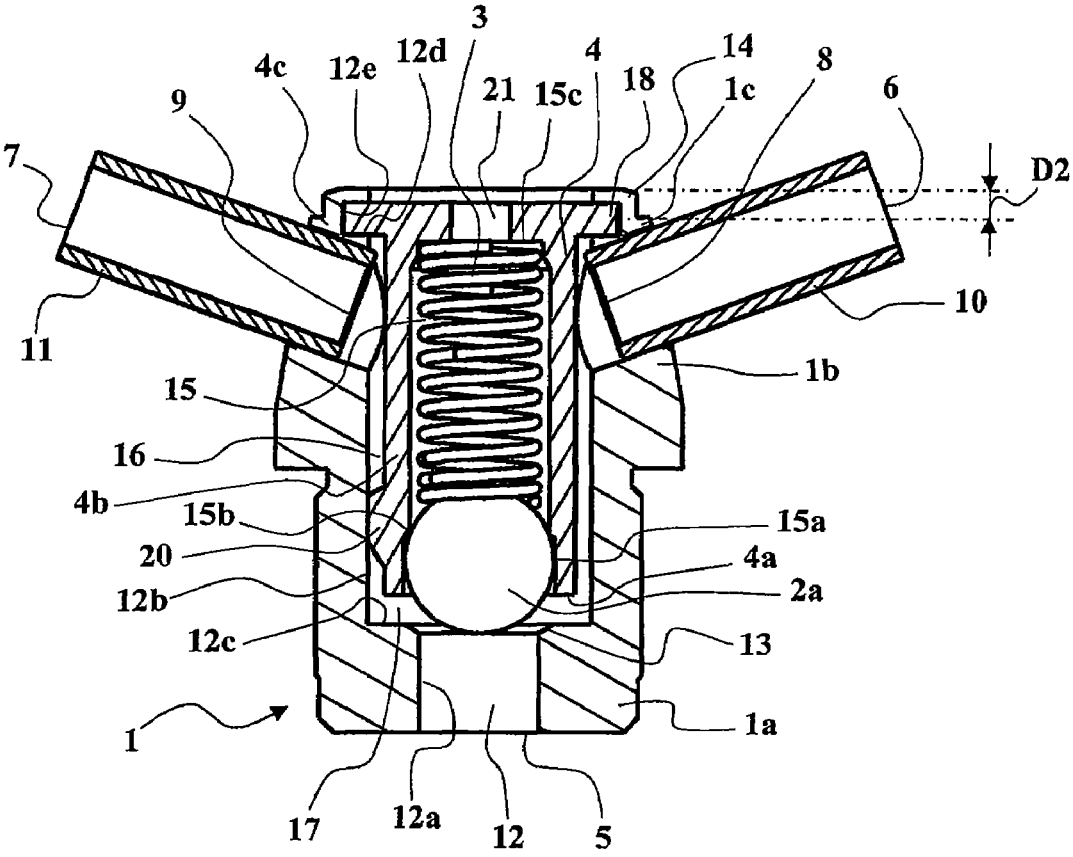
FIG. 10 is a view of the sprayer from FIG. 7 in longitudinal section in an embodiment with downstream centring of the tubular guide liner.

The two variants of the radial excrescences 20 shown in FIGS. 5 and 6 can be used in each of the variants of FIGS. 4 and 10.

This different structure of the retaining means for the tubular guide liner 4 leads to the possibility of reducing the overall size of the sprayer inside the cylinder of the engine. This reduction is seen if FIGS. 3 and 4 or FIGS. 9 and 10 are compared, for example.

In FIG. 3 or 9, the downstream end of the sprayer body 1 is at a distance D1 from the downstream edge of the radial outlet passages 8 or 9.

Likewise, in FIG. 4 or 10, the downstream end of the sprayer body 1 is at a distance D2 from the downstream edge of the radial outlet passages 8 or 9.

The distance D2 is clearly much shorter than the distance D1, the reduction of the distance being made possible in FIGS. 4 and 10 by eliminating the centring section 19.

To benefit from this reduced distance D2, the downstream retaining section 1*c* of the sprayer body 1 is given an axial length just sufficient for accommodating and crimping the annular end flange 18 beyond the radial outlet passages 8 and 9.

In the embodiments of FIGS. 1 to 4, the valve 2 is a piston sliding in the tubular guide liner 4. This sliding is seen on considering in succession FIGS. 2 and 3: in FIG. 2, the valve 2 is in a closed position, bearing on the main seat 13. In FIG. 3, the valve 2 is in an open position, away from the main seat 13, and bearing on the rear seat 15*b*. In the FIG. 3 position, by bearing on the rear seat 15*b* the valve 2 is able to block correctly the axial through-passage 15 and thereby prevent fluid flowing from the main seat 13 to the vent 21. In the case of a valve 2 in the form of a piston, the presence of a rear seat 15*b* is not indispensable.

In the embodiment of FIGS. 7 to 10, the valve 2*a* is a ball, also sliding with a small functional clearance in the tubular guide liner 4. The sliding is visible on considering in succession FIGS. 8 and 9: in FIG. 8, the valve 2*a* is in the closed position, bearing on the main seat 13. In FIG. 9, the valve 2*a* is in the open position, away from the main seat 13 and bearing on the rear seat 15*b*.

In both embodiments, the rear seat 15*b* is disposed axially so that, when the valve 2 or 2*a* is bearing on the rear seat 15*b*, it frees a just sufficient section of the annular fluid passage 17 for the flow of fluid. In practice, the passage left between the valve 2 or 2*a* and the main seat 13 can have substantially the same section as the subsequent fluid flow elements such as the peripheral space 16.

On the other hand, the annular fluid passage 17 and the diameter of the upstream section 12*a* of the axial through-passage are chosen so that, when the valve 2*a* in the form of a ball is in the closed position (FIG. 8), the centre of the valve 2*a* in the form of a ball is further downstream of the upstream end 4*a* of the tubular guide liner 4. This achieves good lateral guidance of the valve 2*a* in the form of a ball in the tubular guide liner 4.

The embodiments that have been described provide high cooling fluid flow rates, with a limited head loss, which tends to improve the performance of the sprayer by achieving high jet speeds.

As seen in the figures, a sprayer can cool more than one piston at a time, in particular in V engines by providing multiple outlet tubes such as the tubes 10 and 11.

The small overall axial size of the sprayer enables its use in most very compact modern engines.

The simplicity and the small number of components significantly reduce the fabrication cost of the sprayer.

The sprayer as described can be fixed by force-fitting the sprayer body into the engine block, without risk of jamming the valve.

The dimensions of the various components and cooling fluid passages will be chosen to satisfy the flow rate specification. The materials can be chosen to satisfy the specifications.

In practice, the various components can be made of metal.

Alternatively, the tubular guide liner 4 can be moulded from plastic material.

The presence of the rear seat 15*b* protects the return spring 3 by limiting its compression, immobilises the valve 2 or 2*a* when the stroke necessary to obtain the required maximum flow rate is reached, and limits leaks through the vent 21 when the cooling fluid is present at high pressure. The particular position of the rear seat 15*b*, which immobilises the valve 2 or 2*a* as soon as the stroke necessary for obtaining the required maximum flow rate is reached, limits leaks to the vent 21 as soon as a relatively low pressure is reached.

The present invention is not limited to the embodiments that have been explicitly described, but includes the various variants and generalisations thereof within the scope of the following claims.

The invention claimed is:

1. A piston cooling sprayer for internal combustion engines, including a sprayer body with an axial passage through it in which are accommodated a tubular guide liner with an axial passage through it and a valve that cooperates with a main seat and a return spring, the sprayer body having an upstream section conformed to be connected to an engine cooling fluid feed passage, an intermediate section with at least one radial outlet passage and one fluid outlet tube, and a downstream retaining section, the tubular guide liner being fixed coaxially in the axial through-passage and having an upstream section leaving a peripheral space for the axial passage of fluid between its external surface and the internal surface of the axial through-passage and between the main seat and the radial outlet passage, the valve sliding axially in the axial passage through the tubular guide liner toward and away from the main seat and being urged axially toward the main seat by the return spring accommodated in the axial passage through the tubular guide liner, wherein:

the main seat is formed in the mass of the sprayer body by a shoulder in the axial through-passage, the tubular guide liner comprises a downstream liner section fixed in the downstream retaining section of the sprayer body beyond the radial outlet passage, the upstream section of the tubular guide liner terminates in an upstream end that is axially set back from the main seat, in the downstream direction, to define an annular fluid passage between the main seat and the peripheral space.

2. The sprayer according to claim 1, wherein the downstream section of the tubular guide liner comprises an annular end flange crimped in a downstream section with a shoulder of the axial through-passage, in the downstream retaining section of the sprayer body.

3. The sprayer according to claim 2, wherein the annular end flange is retained in the downstream section with a shoulder of the axial through-passage by bending an end skirt of the sprayer body over the downstream end face of the annular end flange.

4. The sprayer according to claim 2, wherein the upstream section of the tubular guide liner is centred coaxially in the axial through-passage of the sprayer body by radial excrescences bearing on the wall of the axial through-passage.

5. The sprayer according to claim 4, wherein the downstream retaining section of the sprayer body has a length just sufficient for accommodating and crimping the annular end flange of the tubular guide liner beyond the radial outlet passage.

6. The sprayer according to claim 2, wherein the downstream section of the tubular guide liner comprises a centring section engaged in a corresponding bore of the axial through-passage, in the downstream retaining section of the sprayer body.

7. The sprayer according to claim 1, wherein the tubular guide liner comprises, in its axial through-passage, a downstream constricting shoulder against which is engaged a return coil spring urging the valve toward the main seat and continued by a vent.

8. The sprayer according to claim 1, wherein the tubular guide liner comprises, from its upstream end, a guiding bore in which the valve slides with a small functional clearance and that is limited by a shoulder forming a rear seat against which the valve bears in sealed fashion when it is pushed back by the fluid under pressure.

9. The sprayer according to claim 8, wherein the rear seat is disposed so that, when the valve is bearing on the rear seat, it frees a just sufficient section of the annular fluid passage for the required flow of the cooling fluid.

10. The sprayer according to claim 1, wherein the valve is a piston or a ball.

* * * * *